US006047967A

United States Patent [19]

Murphy et al.

[11] Patent Number: 6,047,967

[45] **Date of Patent: *Apr. 11, 2000**

[54] GOLF GAME

[76] Inventors: Steve W. Murphy, 8 Winston Park Blvd., North York, Ont., Canada, M3K 1B9; R. Jay Begg, 131 Mill St. W., Aeton, Ontario, Canada, L7J 1G7

[ * ] Notice: This patent issued on a continued prosecution application filed under 37 CFR 1.53(d), and is subject to the twenty year patent term provisions of 35 U.S.C. 154(a)(2).

[21] Appl. No.: 08/954,559

[22] Filed: Oct. 20, 1997

[51] Int. Cl.[7] ..... A63F 9/04

[52] U.S. Cl. ..... 273/245

[58] Field of Search ..... 273/245

[56] References Cited

U.S. PATENT DOCUMENTS

| | | | |
|---|---|---|---|
| 1,529,598 | 3/1925 | Lee . | |
| 1,758,581 | 5/1930 | Morch . | |
| 3,658,339 | 4/1972 | Boileau . | |
| 3,826,498 | 7/1974 | Monek . | |
| 3,944,229 | 3/1976 | Feeney . | |
| 3,989,249 | 11/1976 | Breslow . | |
| 4,106,774 | 8/1978 | Seguin | 273/245 |
| 4,277,065 | 7/1981 | White . | |
| 4,856,780 | 8/1989 | Begley et al. . | |
| 5,000,460 | 3/1991 | Barbiaux et al. . | |
| 5,145,173 | 9/1992 | Crowder . | |
| 5,234,218 | 8/1993 | LaRocca . | |
| 5,470,077 | 11/1995 | Brewster | 273/245 |

*Primary Examiner*—Jeanette Chapman
*Assistant Examiner*—Stephen L. Blau
*Attorney, Agent, or Firm*—David J. Heller; Ridout and Maybee

[57] ABSTRACT

A golf game is based on the use of dice to generate the results of a drive shot, a fairway shot, and a putt. The results of the dice correspond to results known to the actual game of golf. The game may not require the use of boards or charts to play, and one roll can determine the result of one hole of the game.

8 Claims, 4 Drawing Sheets

(RED)

(RED)

(BLACK)

(BLUE)

(YELLOW)

(GREEN)

FIGURE 9

| HOLE | 1 | 2 | 3 | 4 | 5 | 6 | 7 | 8 | 9 | OUT | 10 | 11 | 12 | 13 | 14 | 15 | 16 | 17 | 18 | IN | TOTAL |
|---|---|---|---|---|---|---|---|---|---|---|---|---|---|---|---|---|---|---|---|---|---|
| PAR | 4 | 4 | 3 | 5 | 4 | 4 | 3 | 5 | 4 | 36 | 4 | 3 | 5 | 4 | 4 | 4 | 5 | 3 | 4 | 36 | 72 |
| Steve | | | | | | | | | | | | | | | | | | | | | |
| Jay | | | | | | | | | | | | | | | | | | | | | |
| David | | | | | | | | | | | | | | | | | | | | | |
| Robin | | | | | | | | | | | | | | | | | | | | | |

GOLF GAME

FIELD OF THE INVENTION

This invention relates to a game that simulates the basic game of golf.

BACKGROUND OF THE INVENTION

A number of games have been devised which simulate the game of golf. Generally, these games require the use of a diagram or a number of diagrams representing the holes of the golf course, which generally include a tee, fairway, obstacles and a green. Advancement of the golf ball is generally determined by consulting chance means (usually dice and/or cards) and accompanying charts for determining the direction and/or distance of travel of the ball. For example, Morch (U.S. Pat. No. 1,758,581), Monek (U.S. Pat. No. 3,826,498), Breslow (U.S. Pat. No. 3,989,249), White (U.S. Pat. No. 4,277,065), Trimble (U.S. Pat. No. 4,809,985), Barbiaux et al. (U.S. Pat. No. 5,000,460) and LaRocca (U.S. Pat. No. 5,234,218) each teach golf games which require that the player consults charts to interpret the effect that the chance means result has on the play of the game.

Other games have circumvented the requirement of the use of charts through the use of diagrams. Lee (U.S. Pat. No. 1,529,598) provide letters on a map of a fairway which correspond to letters on the dice, combined with a system for advancement along the letters on the fairway. Boileau, (U.S. Pat. No. 3,658,339) and Feeney (U.S. Pat. No. 3,944,229) provide golf course game boards with diagrams representing fairways, various drive lengths on the fairways, bunkers, greens, and holes, for marking the position of the ball with game pieces after each chance means result. These games require the use of a game board and markers to mark the position of the ball between rolls of the dice by a player because the score for each hole is based on the number of dice rolls (or other chance means results) required to hole out. Unless a hole-in-one is obtained, multiple casts of the dice or multiple uses of another chance means are required to hole out.

All of the above-noted games require the use of a physical system of game boards, charts, or both for keeping track of the position of the ball from stroke to stroke. Diagrams and/or charts must be consulted throughout the game and compared against the results of the chance means in order to play the game. None of these games can be played using only their chance means. The requirement of diagrams or charts creates games which are less portable, and which require some amount of surface space to set up and play the game.

The requirement of charts and/or diagrams to generate a wide variety of possible outcomes and a wide range of probabilities may be a reflection of the wide variety of possible outcomes for any given shot in an actual game of golf. For example, from a drive shot alone, a ball may end up in a bunker or other hazard, may land on the green, may land on a fairway, and there is even a very slight chance of a hole-in-one. Some game developers have tried to develop games which reflect this wide range of possible outcomes with some adherence to the actual probability of the outcome in a real golf game. This is resulted in development of very complex games (see, for example, White; U.S. Pat. No. 4,277,065).

Where game developers have tried to devise games which are simpler, the games generally tend to either ignore possible outcomes for any given stroke, or introduce the probabilities into the game which are completely divorced from the real game of golf. For example, by use of LaRocca's game (U.S. Pat. No. 5,234,218), on a par 3, by consulting the charts, dice, and rules of the game, it can be calculated that a hole-in-one will result 1 out of every 8 drive shots, while a hole-in-one is not possible where the hole is not par 3. Lee's game (U.S. Pat. No. 1,529,598) does not provide for the possibility of a hole-in-one, and the number of strokes required may depend in part on the number of people playing the hole, unlike an actual golf game.

SUMMARY OF THE INVENTION

The present invention teaches a golf game which is based on the use of dice or other chance means to determine and display the results of a drive shot, a fairway shot, and a putter. The game thus may be easy to play and portable.

In one aspect, the golf game comprises a driver chance means, having driver indicia corresponding to a plurality of results of a drive shot, for randomly displaying a driver indicia, a fairway chance means, having fairway indicia corresponding to a plurality of results of a fairway shot, for randomly displaying a fairway indicia, and, a putter chance means, having putter indicia corresponding to a plurality of results of a putter shot, for randomly displaying a putter indicia.

One or more indicia on each of the driver and/or fairway chance means may correspond to a drive onto the green, and/or may correspond to an extra stroke, or some other result known to the actual game of golf.

The chance means may be actuated one after another, or, preferably may be actuated all at once. The chance means may be dice, roulette wheels, cards, electronic random result generating devices, or the like. In a preferred embodiment, the chance means are cubic dice However, it will be appreciated that the dice may have more or less than six sides. Furthermore, in other embodiments, the chance means may be slot machine reels, and the game may be played on a slot machine. Similarly, in another embodiment, the game may be electronic, such as a computer video game, and the chance means may be electronic random number generators.

In one embodiment of the invention, each chance means has a "hole-in-one" icon corresponding to one indicia. This may allow for the possibility of achieving a hole in one during play of the game.

In yet another embodiment, the chance means each have markings to distinguish an order in which said indicia on said chance means are to be consulted in the play of the game.

In another embodiment, there is a plurality of fairway chance means.

In a preferred embodiment, there is a plurality of fairway chance means, the chance means are marked to indicate the order of play, and the order of play of the fairway chance means is such that the subsequent chance means have an increased probability of obtaining a result corresponding to a shot onto the green, relative to the preceding chance means.

BRIEF DESCRIPTION OF THE FIGURES

FIG. 9 is a golf card for use with a golf game in accordance with in the present invention.

DETAILED DESCRIPTION OF A PREFERRED EMBODIMENT

As with an outdoor game of golf, the present invention presents a game of competition with the object of simulating the exercise of getting the ball from the tee into the hole with the least number of strokes. Each hole of the golf game begins with a tee shot or drive followed by the possibility of approach shots on the fairway and putts on the green. In a preferred embodiment, the advancement of the ball from the tee to the pin or hole is determined by a roll of dice.

Figure 1:
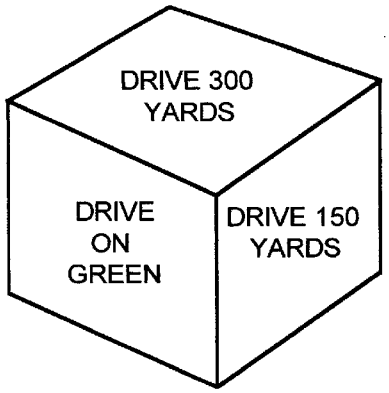
FIG. 1 is a perspective view of five dice for playing a golf game in accordance with the present invention.

Referring now to the figures, FIG. 1 represents dice 10 of the present invention. It will be appreciated that dice are merely one example of a chance means for generating and displaying chance results corresponding to the results of a shot. Slot machine reels, roulette wheels, cards, electronic random result generating devices, or the like may also be used as chance means. For clarity in describing the present embodiment the actuation of the chance means and consultation of the result thereof is referred to herein as a roll of the dice, using the example of an embodiment in which the chance means are dice.

In the preferred embodiment, as shown in FIG. 1, dice 10 are cubic. However, in other embodiments, the dice may have any number of sides (ie. three or more).

In the preferred embodiment, the game has five dice: driver die 100 which corresponds to the drive or tee shot; three fairway die 200, 300, and 400, which correspond to fairway shots; and putter die, 500, which corresponds to putting.

In other embodiments, the game may have three or more dice. With three dice, the game may be played with a driver die, a fairway die, and a putter die. In still other embodiments, there may be multiple driver dice, allowing one to select the best drive result among the driver dice, or there may be multiple putter dice, allowing one to select the best putter result among the putter dice, or to select a combination of putter indicia.

Dice 10 may be rolled one after another or preferably are rolled all at the same time. In the preferred embodiment, depending on the player's role, two to five dice are required to complete the hole in play.

In the preferred embodiment described herein, dice 10 have color markings which assist a player to determine the order in which the dice are to be consulted. As indicated in FIG. 1, driver die 100 is red, first fairway die 200 is black, second fairway die 300 is blue, third fairway die 400 is yellow, and putter die 500 is green. The preferred embodiment has further markings to assist the player in determining their order of play. Referring now to FIGS. 2 to 6, driver die 100 has the word "Drive" on five of its six sides, first fairway die 200 has the term "2nd" on each side, second fairway has the term "3rd" on each side, third fairway die 400 has the term "4th" on each side, and putter die 500 has the term "putt" on each side. In other embodiments, marking to determine order of play can be done by use of, for example, numbers, letters, colors, shadings of a color or grey, or other indicia on dice 10.

In an alternative embodiment, the dice may not be marked according to the order in which they are to be consulted. Thus, during the play of the game, the player may be required to consider the various stroke results presented by the dice, and make a selection as to the best possible order in which to select the dice's results.

Figure 2:
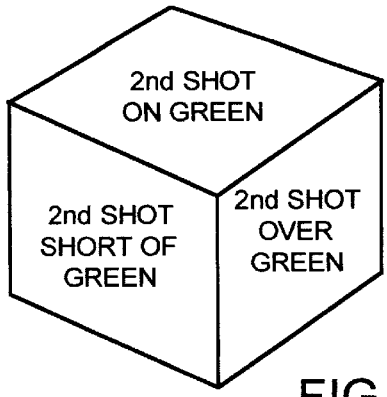
FIG. 2 is a plan view of the faces for the drive shot die of FIG. 1.

Referring now to FIG. 2, indicia on driver die 100, showing the result of the tee shot, are:

Indicia 102—Drive 300 yards

Indicia 104—Drive 250 yards

Indicia 106—Drive 150 yards (with flag icon)

Indicia 108—Drive duffed/2nd shot in trap

Indicia 110—Out of bounds/3rd shot in trap/4th shot on green

Indicia 112—Drive on Green

A roll of driver die 100 will indicate the result of the drive shot. The result of driver die will also determine whether or not a fairway die result must be considered. If the drive shot puts the ball on the green, the fairway dice are not required for play. If the drive did not place the ball on the green, the fairway dice results are consulted.

Figure 3:
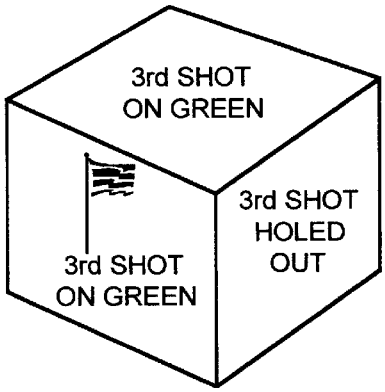
FIG. 3 is a plan view of the faces for the first fairway shot die of FIG. 1.

Referring now to FIG. 3, the indicia on first fairway die 200 are:

Indicia 202—2nd shot on green (with flag icon)

Indicia 204—2nd shot short of green

Indicia 206—2nd shot over green

Indicia 208—2nd shot in water/1 penalty/4th shot on green

Indicia 210—2nd shot in trap

Indicia 212—2nd shot duffed

Figure 4:
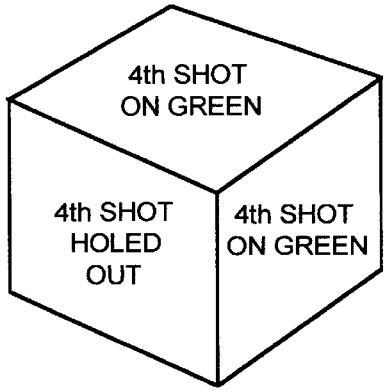
FIG. 4 is a plan view of the faces for the second fairway shot die of FIG. 1.

Referring now to FIG. 4, the indicia on second fairway die 300 are:

Indicia 302—3rd shot on green (with flag icon)

Indicia 304—3rd shot short of green

Indicia 306—3rd shot holed out

Indicia 308—3rd shot duffed

Indicia 310—3rd shot on green

Indicia 312—3rd shot short of green

Figure 5:
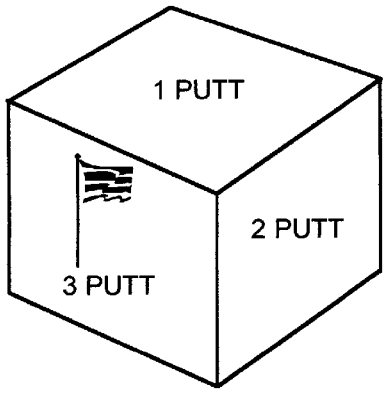
FIG. 5 is a plan view of the faces for the third fairway shot die of FIG. 1.

Referring now to FIG. 5, the indicia one third fairway die 400 are:

Indicia 402—4th shot in trap/5th shot on green

Indicia 404—4th shot on green (with flag icon)

Indicia 406—4th shot holed out

Indicia 408—4th and 5th shots duffed/6th shot on green

Indicia 410—4th shot duffed/5th shot on green

Indicia 412—4th shot on green

In the preferred embodiment, there are a plurality of fairway dice, 200, 300, and 400. The fairway dice results may put the ball on the green. Alternately, the fairway dice result may indicate that the ball has landed in the water and that a penalty stroke must be counted, that the ball has landed in a trap, in the rough, that the shot has been duffed (mishit), and/or simply that a stroke was taken and a further fairway shot is required; a subsequent fairway die result is then consulted.

The subsequent fairway die result will be determined by the roll of a separate fairway die. Having multiple fairway dice facilitates the play of the game in that one roll of all the dice corresponds to one hole. All dice can be consulted and the result of the hole can be determined without resorting to the use of an ongoing recordal of the "location" of each ball in relation to the hole, between rolls of the dice. Alternatively, in other embodiments, the subsequent fairway die result may be generated by re-rolling the same fairway die which has just been consulted.

In the preferred embodiment, 3 fairway dice 200, 300, and 400 are used, and the probability of any given fairway die indicating that the ball has reached the green varies between fairway dice.

Also in the preferred embodiment, fairway dice 200, 300, and 400 are marked such that the order in which they are to be consulted is predetermined (fairway die 200, then fairway die 300, then fairway die 400), and the probability of any given fairway die indicating that the ball has reached the green increases as one ascends through this order. In this way, the game is reflective of the actual game of golf, wherein successive shots on the fairway generally increase one's probability of reaching the green, relative to the previous shot.

Figure 6:
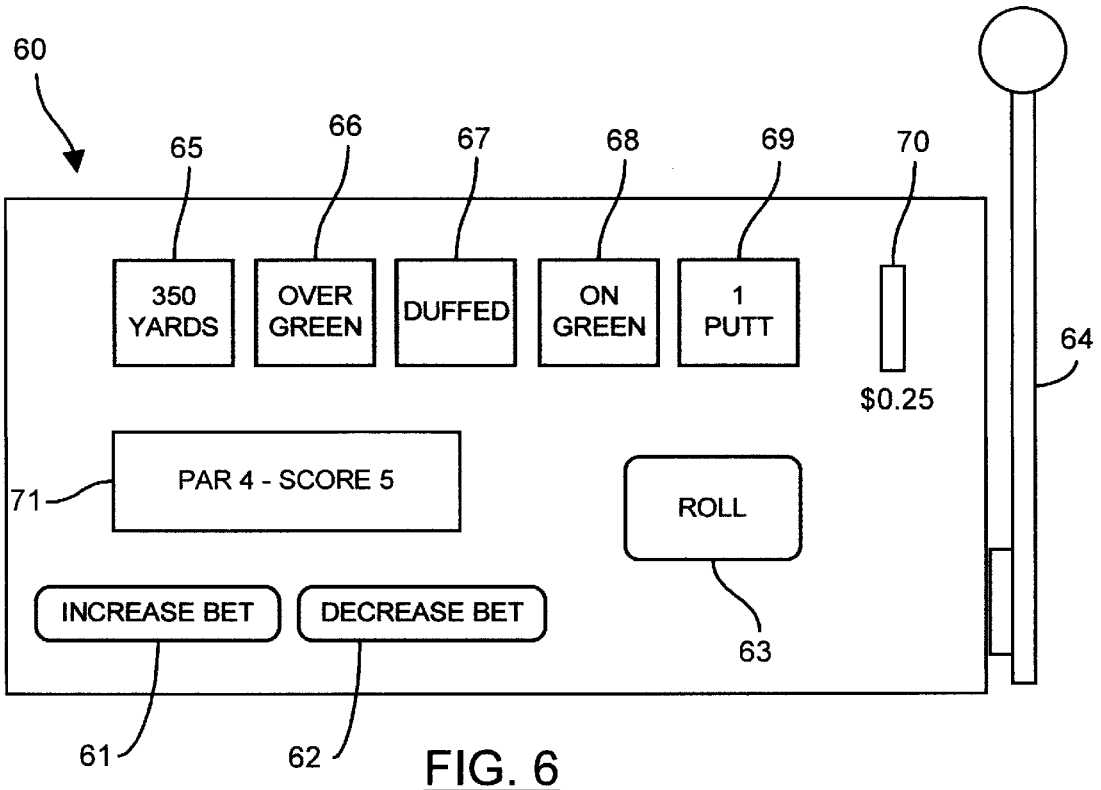
FIG. 6 is a plan view of the faces for the putter die of FIG. 1.

Referring now to FIG. 6, the indicia on putter 500 are:

Indicia 502—1 putt

Indicia 504—2 putt

Indicia 506—3 putt (with flag icon)

Indicia 508—2 putt

Indicia 510—1 putt

Indicia 512—3 putt

Once either driver die 100 or one of fairway dice 200, 300, or 400 indicates that the ball has reached the green, putter die 500 is consulted. The putter die result corresponds to putting on the green. In the present example, the putter die result will indicate the number of putts required on the green to sink the ball into the hole. In other embodiments, there may be one or more putter dice which indicate a result that the player has either holed out or the player must putt again, or that the ball has been putted off the green.

Thus, in the present example, all of the dice 10 required to play one hole are rolled simultaneously. The dice 10 are then consulted to determine the number of strokes required to sink the ball. Driver die 100 is consulted first, and depending on the result of the driver die, fairway die 200, 300 and/or 400 and/or the putter die may be consulted.

In the preferred embodiment of the golf game, the dice or other random result generating means allow for the possibility of a hole-in-one. One side of each of the dice is marked with hole-in-one icon 20 (flag icon 20). Icon 20 does not replace the other indicia discussed above, but occurs with the indicia of one side of each dice. In the present example, as seen in FIGS. 2 to 6, icon 20 occurs with indicia 106, 206, 302, 404, and 506. Where a player obtains a roll of the dice in which all of the dice display hole-in-one icon 20, on its top side, a hole-in-one is counted regardless of the other indicia on the dice. Thus, in the present example using five six-sided dice, the odds of achieving a hole-in-one are $1{:}6^5$; i.e. 1 in 7,776.

In other embodiments, there may be more than one hole-in-one icon on each die, or there may be a separate die or other chance means used to determine whether or not the player has obtained a hole-in-one.

By way of example, and referring to the figures, the game may be played as follows. Where a hole-in-one is obtained (ie. all dice show flag icons 20), the player scores one stroke for the hole.

Where a hole-in-one is not obtained, driver die 100 is first consulted to determine which of the subsequent dice should be used in determining the score. If driver die 100 indicates "drive on green" indicia 112, one stroke is counted, and putter die 500 is then considered to determine the number of putts required to sink the ball. Once the ball is on the green, subsequent fairway dice are not required, and strokes are not counted for those dice.

If the result is indicia 110, "out of bounds/3rd shot in trap/4th shot on green", the player counts a total of four strokes, which correspond to one tee shot, one penalty stroke (out of bounds), one shot into trap, and one shot onto green, and consults putter die 500. If driver die 100 does not land the ball upon the green, the player will count either one stroke (indicia 102, "drive 300 yards", 104, "drive 250 yards", or 106, "drive 150 yards") or 2 strokes (indicia 108, "drive duffed/second shot in trap"), and will consult the first fairway die, FIG. 2.

The first fairway shot may land the ball on the green (indicia 202). Once on the green the player will consult the putter die 500. If first fairway die 200 does not put the ball on the green, the ball will either be duffed (indicia 212), land the ball on the green with a penalty stroke (indicia 208), or remain on the fairway (indicia 204, 206, or 210). The player will then count the appropriate number of strokes in accordance with the rules of an actual golf game, and consult second fairway die 300.

Second fairway die 300 is considered as required and strokes are counted in a similar manner as was the result of driver die 100 and first fairway die 200, i.e. according to the rules of the actual game of golf.

Third fairway die 400, is similarly considered and strokes are counted, as required. The overall results of fairway dice 200, 300, and 400 will either put the player on the green (indicia 202, 208, 302,310, 402, 404, 408, 410, or 412), or hole out the player (indicia 306 or 406).

Upon reaching the green, if the player has not holed-out by means of a hole-in-one or indicia 306 or 406, putter die 500 is considered. The putter die result indicates the number of putts required to sink the ball, as shown in FIG. 6.

It will be appreciated that the indicia used on the dice can be varied extensively, so long as the basic elements of the game, as claimed herein, are adhered to.

The total strokes for the hole are tallied in the same manner as the actual game of golf. Only dice results which are required for play are tallied, as shown by the following examples.

| Rolled: | |
|---|---|
| **Play Scenario Example #1:** | |
| Driver die 100 result: | Drive 300 yards (indicia 102) |
| First fairway die 200 result: | 2nd shot short of green (indicia 204) |
| Second fairway die 300 result: | 3rd shot holed out (indicia 306) |
| Third fairway die 300 result: | 4th shot on green (not required) (indicia 412) |
| Putter die 500 result: | 1 putt (not required) (indicia 502) |
| Score: 3 strokes | |
| **Play Scenario Example #2:** | |
| Driver die 100 result: | Drive out of bounds/3rd shot trap/4th green (indicia 102) |
| First fairway die 200 result: | 2nd shot water/1 penalty/4th on green (not required) (indicia 204) |
| Second fairway die 300 result: | 3rd shot short of green (not required) (indicia 306) |
| Third fairway die 400 result: | 4th and 5th duffed/6th on green (not |

-continued

| Rolled: | |
|---|---|
| | required) (indicia 412) |
| Putter die 500 result: | 2 put (indicia 502) |
| Score: 6 strokes | |

Play Scenario Example #3:

| | |
|---|---|
| Driver die 100 result: | Drive 300 yards (indicia 102) |
| First fairway die 200 result: | 2nd shot over green (indicia 204) |
| Second fairway die 300 result: | 3rd shot duffed (indicia 306) |
| Third fairway die 400 result: | 4th shot holed out (indicia 412) |
| Putter die 500 result: | 3 putt (not required) (indicia 502) |
| Score: 4 strokes | |

If desired, the total number of strokes for the hole is entered onto a game card, as shown in FIG. 9, or other recording means. The dice are then rolled by a subsequent player, if any.

The game may comprise one hole of golf or any number of holes. Where the game consists of a plurality of holes, players may wish to use a recording means for recording the number of strokes per player per hole. The players may wish to total the number of strokes incurred for a given number of holes, and decide the outcome of the game based on the total number of strokes, as in the actual game of golf. The recording means may be scoring cards which are used in actual golf games. Alternately, players can "create the own golf course", by selecting the number of holes and the par for each hole, and creating a card, such as is shown in FIG. 9.

The game is suitable for any number of players. A player can compete against himself by trying to beat a previous score or a predetermined par. Alternately, several players can compete against each other.

As seen in FIG. 6, where slot machine reels are used as the chance means, the game can be incorporated into a slot machine, and the game can include betting on the outcome of each hole. The value of the wager could be increased or decreased by pressing, respectively, increase bet button 61 or decrease bet button 62. If desired, the wager could be monetary, and money or an apparatus with a monetary value could be entered into the machine by means of slot 70. For example, the player could bet that he will achieve par for the hole. Alternately, the player could bet that he will achieve under par for the hole. The type of bet, and thus the probability of winning and the payout upon winning could be modified, for example, by pressing increase bet button 61 or decrease bet button 62.

The player then activates slot machine 60, by pulling lever 64 or by pressing roll button 63 which, in turn, activates reels 65, 66, 67, 68, and 69. The machine could stop all the reels at the same time, or could allow for the player to stop the reels individually. The possible results displayed on each reel may be the same as those described in the dice embodiment above. The overall result which is produced by the reels is determined by applying the concepts of the game, as described above. Depending on the result produced by the reels, and the type of bet, the player may either win or lose the wager.

Figure 7:
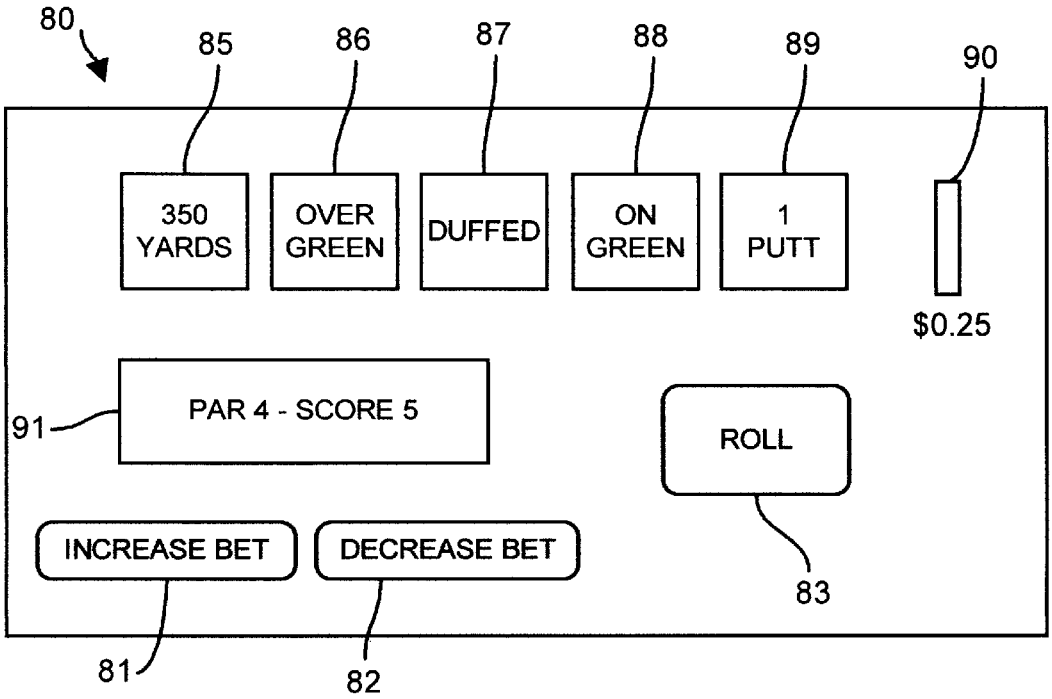
FIG. 7 is a front view of a mechanical slot machine incorporating a golf game in accordance with the present invention.
Figure 8:
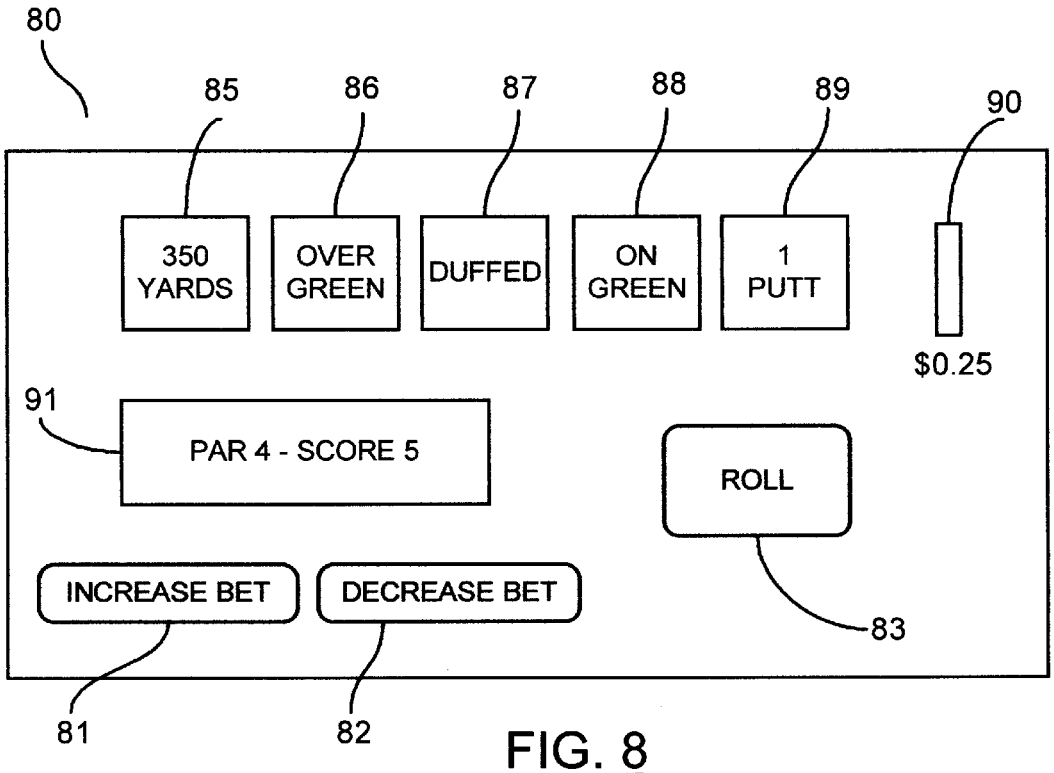
FIG. 8 is a front view of a electronic gaming machine incorporating a golf game in accordance with the present invention.

In a related embodiment, as seen in FIG. 7, an electronic gaming device 80 can be used to play the game. In this embodiment, electronic random result generating devices are used as the chance means. As above, the game can include betting on the outcome of each hole. The value of the bet could be increased or decreased by pressing increase bet button 81 or decrease bet button 82. If desired, the bet could include a monetary wager, which can be entered into the machine by means of slot 90. The type of bet, and thus the probability of winning and the payout upon winning could be modified, for example, by pressing increase bet button 81 or decrease bet button 82.

The player then activates electronic random result generating devices (not shown) inside gaming device 80 by pressing roll button 83. The results of the electronic random result generating devices are translated by a computer means (not shown) into results shown on displays 85 to 89. The possible results may be the same as those described in the dice embodiment above. The machine could display the results simultaneously, or gaming device 80 could allow for the player to generate and view the results of each of displays 85, 86, 87, 88 and 89 individually. The overall result which is produced by the random result generating devices is determined in by applying the concepts of the game, as described above. Depending on the result produced by the random result generating devices, and the type of bet, the player may either win or lose the wager.

It will be understood that no limitation of the scope of the invention is hereby intended. While the invention has been disclosed and described with reference to a limited number of embodiments, those skilled in the art will appreciate that the various modifications, variations and additions to the process may be made, and it is therefore intended in the following claims to cover each such variation, addition and modification as falls within the true spirit and scope of the invention. Such alterations and further modifications in the described device, and such applications of the principals of the invention as is described herein as would normally occur to one skilled in the art to which the invention relates, are considered as included in the invention.

We claim:

1. A method of playing a golf game comprising:

actuating a driver chance means having driver indicia corresponding to a plurality of results of a drive stroke, a fairway chance means having fairway indicia corresponding to a plurality of results of a fairway stroke and a putter chance means having putter indicia corresponding to a plurality of results of a putter stroke, only once per hole, to randomly generate and display indicia of said chance means wherein actuating said driver chance means, said fairway chance means, and said putter means occur at a same time, wherein said driver chance means, said fairway chance means, and said putter chance means are not a same means; and observing the displayed indicia to determine the result for a hole.

2. A method as claimed in claim 1 wherein each of said chance means has an indicia corresponding to a hole-in-one and, in the step of determining the result for a hole, if all said actuated chance means display said indicia, a hole in one shot is obtained.

3. A method as claimed in claim 1 further comprising actuating a plurality of fairway chance means.

4. A method as claimed in claim 1 wherein said driver chance means has an indicia corresponding to a drive onto the green, and in the step of determining the result for a hole, if said driver chance means displays said indicia, a drive onto the green is obtained.

5. A method as claimed in claim 1 wherein said driver chance means has an indicia corresponding to an extra stroke, and in the step of determining the result for a hole, if said actuated driver chance means displays said indicia, an extra stroke is counted.

6. A method as claimed in claim 1 wherein said fairway chance means has an indicia corresponding to an extra stroke, and in the step of determining the result for a hole, if said actuated fairway chance means displays said indicia, an extra stroke is counted.

7. A method as claimed in claim 1 wherein said driver, fairway and putter chance means are dice, and in the step of actuating said chance means, the dice are rolled.

8. A method as claimed in claim 7 wherein said dice are cubic.

* * * * *